US009337551B2

(12) United States Patent
Uchida et al.

(10) Patent No.: US 9,337,551 B2
(45) Date of Patent: May 10, 2016

(54) TERMINAL-EQUIPPED WIRE AND METHOD FOR MANUFACTURING THE SAME

(71) Applicant: Yazaki Corporation, Tokyo (JP)

(72) Inventors: Naonari Uchida, Susono (JP); Hiroshi Ishiuchi, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/696,669

(22) Filed: Apr. 27, 2015

(65) Prior Publication Data

US 2015/0229037 A1 Aug. 13, 2015

Related U.S. Application Data

(63) Continuation of application No. PCT/JP2013/079582, filed on Oct. 31, 2013.

(30) Foreign Application Priority Data

Nov. 2, 2012 (JP) ..... 2012-242417

(51) Int. Cl.

| | |
|---|---|
| ***H01R 4/18*** | (2006.01) |
| ***H01R 43/01*** | (2006.01) |
| ***H01R 4/24*** | (2006.01) |
| ***H01R 43/048*** | (2006.01) |
| *H01R 4/22* | (2006.01) |

(52) U.S. Cl.

CPC ..... *H01R 4/183* (2013.01); *H01R 4/185* (2013.01); *H01R 4/2404* (2013.01); *H01R 43/01* (2013.01); *H01R 43/048* (2013.01); *H01R 4/22* (2013.01); *Y10T 29/49185* (2015.01)

(58) Field of Classification Search

CPC ..... H01R 43/01; H01R 4/185; H01R 4/22; H01R 4/183; H01R 43/048; H01R 4/2404; Y10T 29/49185

USPC ..... 439/877, 868, 879–882, 887, 421, 275, 439/442, 730, 406; 29/863

See application file for complete search history.

(56) References Cited

U.S. PATENT DOCUMENTS

| | | | | |
|---|---|---|---|---|
| 7,115,004 | B2 * | 10/2006 | Takayama | H01R 4/185 439/850 |
| 8,834,213 | B2 * | 9/2014 | Sato | H01R 4/185 439/866 |
| 2012/0329343 | A1 | 12/2012 | Sato et al. | |
| 2013/0130569 | A1 * | 5/2013 | Sato | H01R 4/206 439/882 |

FOREIGN PATENT DOCUMENTS

| | | | |
|---|---|---|---|
| JP | 59-219881 | A | 12/1984 |
| JP | 2010-092647 | A | 4/2010 |
| JP | 2012-028154 | A | 2/2012 |

OTHER PUBLICATIONS

International Search Report mailed Dec. 24, 2013, issued for PCT/JP2013/079582.

* cited by examiner

*Primary Examiner* — Edwin A. Leon
(74) *Attorney, Agent, or Firm* — Locke Lord LLP

(57) ABSTRACT

There is provided a terminal-equipped wire able to reduce a production cost and satisfy water proof and corrosion proof performances at a terminal section of the electric wire. The terminal-equipped wire includes: an electric wire having a conductor in an insulating coating; and a terminal fitting crimped to a terminal section of the electric wire. The terminal fitting includes: an electrical contact portion for connecting with a terminal fitting of the mating connector; and a wire connection portion for connecting with the terminal section of the electric wire continuing to the electrical contact portion. The wire connection portion includes: a grip for gripping the terminal section of the electric wire along a circumferential direction of the electric wire; and a projection penetrating the insulating coating. The conductor and the terminal fitting have electrical continuity with each other via the projection.

3 Claims, 6 Drawing Sheets

TERMINAL-EQUIPPED WIRE AND METHOD FOR MANUFACTURING THE SAME

TECHNICAL FIELD

The present invention relates to a terminal terminal-equipped wire, and a method for manufacturing a terminal-equipped wire, in particular, to a terminal-equipped wire having a conductor in an insulating coating and a terminal fitting crimped to a terminal section of this electric wire, and a method for manufacturing this terminal-equipped wire.

BACKGROUND ART

Conventionally, various electronic devices are mounted on a vehicle or the like, and a wiring harness is arranged therein for transmitting electric power, a control signal, and the like. The wiring harness includes: a plurality of electric wires; terminal fittings attached to terminal sections of the electric wires; and a connector receiving the terminal fittings. When this connector is fitted with a mating connector, the terminal fittings of both connectors are electrically connected to each other, and the electronic devices are connected by the wiring harness. The terminal fitting is made by folding a conductive metal plate or the like, and includes: a wire connection portion for connecting with the electric wire; and an electrical contact portion for connecting with the terminal fitting of the mating connector.

Further, the terminal-equipped wire having a terminal fitting attached to a terminal section of the electric wire is typically made by removing an insulating coating from a terminal section of the electric wire (peeling the wire) to expose an conductor, and by swaging the conductor with a front leg of the terminal fitting to fix, and by swaging the insulating coating with a rear leg of the terminal fitting to fix, and whereby the conductor of the electric wire and the terminal fitting are electrically connected to each other, and the electric wire and the terminal fitting are mechanically connected to each other. On the other hand, because the exposed conductor and the front leg of the terminal fitting closely contact each other in a pressure condition, when the water or a chemical attach to this connection portion, galvanic corrosion may be generated in the conductor or the terminal fitting to deteriorate the terminal-equipped wire. Therefore, a water proof structure and a corrosion proof structure of the connection portion have been proposed (for example, refer to PTL 1).

As shown in FIG. 9, the terminal-equipped wire described in PTL 1 has an electric wire 1 having a conductor 1B in an insulating coating 1A, and a terminal fitting 2 crimped to a terminal section 1C of the electric wire 1, and is manufactured by the following procedure. First, as shown in FIG. 9A, the insulating coating 1A having a specific length at the terminal section of the electric wire 1 is removed by peeling, and the conductor 1B at the terminal section 1C is exposed. Next, as shown in FIG. 9B, the terminal section 1C of the electric wire 1 is inserted into rear legs 2A and front legs 2B of the terminal fitting 2, the electric wire 1 is swaged with the rear legs 2A from outside of the insulating coating 1A, and the exposed conductor 1B is swaged with the front legs 2B. Thereby, the electric wire 1 and the terminal fitting 2 are electrically and mechanically connected to each other. Further, as shown in FIG. 9C, a resin portion R is made by covering the terminal section 1C of the electric wire 1 swaged by the rear and front legs 2A, 2B with resin, and this resin portion R works as a water proof and corrosion proof member for the terminal section 1C.

CITATION LIST

Patent Literature

[PTL 1]
JP 2012-28154A

SUMMARY OF INVENTION

Technical Problem

However, in the conventional terminal-equipped wire, because the resin portion R covers the terminal section 1C of the electric wire 1 and as a water proof and corrosion proof member, a process and a device for covering the terminal section 1C with resin are needed. Due to this, there is a problem that a production process becomes lengthy, and device cost and material cost are increased.

Accordingly, an object of the present invention is to provide a terminal-equipped wire able to reduce a production cost and satisfy water proof and corrosion proof performances at a terminal section of the electric wire.

Solution to Problem

For attaining the above object, according to one aspect of the present invention, there is provided a terminal-equipped wire including:

an electric wire having a conductor covered by an insulating coating; and a terminal fitting crimped to a terminal section of the electric wire, wherein the terminal fitting includes: an electrical contact portion for being electrically connected to a mating connector; and a wire connection portion for being connected to the terminal section of the electric wire continuing to the electrical contact portion, wherein the wire connection portion includes: a grip for gripping the terminal section of the electric wire along a circumferential direction of the electric wire; and a projection provided integrally with or independently from the grip and penetrating the insulating coating, and wherein the conductor electrically continues to the grip via the projection.

According to a first preferred aspect of the present invention, there is provided the terminal-equipped wire as in the one aspect of the present invention, wherein the grip includes a pair of legs for gripping the terminal section of the electric wire by swaging, and wherein while the electric wire is gripped, tips of the pair of legs are continued to each other in a circular shape or in a flat shape along the circumferential direction of the electric wire.

According to a second preferred aspect of the present invention, there is provided the terminal-equipped wire as in the one or the first preferred aspect of the present invention, wherein the projection is either projected from an inner surface of the grip and formed integrally with the grip, or projected from an inner wall of a bottomed cylindrical cap member that is conductive attached to the terminal section of the electric wire and provided independently from the grip.

According to a second aspect of the present invention, there is provided a method for manufacturing a terminal-equipped wire, the terminal-equipped wire comprising:

an electric wire having a conductor covered by an insulating coating; and a terminal fitting crimped to a terminal section of the electric wire, the terminal fitting including: an electrical contact portion for connecting with the terminal fitting of a mating connector; and a wire connection portion for being connected to the terminal section of the electric wire continuing to the electrical contact portion, the wire connection portion including: a grip for gripping the terminal section of the electric wire along a circumferential direction of the electric wire; and a projection projected from an inner surface of the grip, the method comprising the steps of:

inserting the terminal section of the electric wire into the grip;

swaging the grip to press the terminal section of the electric wire and to penetrate the insulating coating with the projection, thereby allowing the conductor to have electrical continuity with the grip via the projection.

According to a third aspect of the present invention, there is provided a method for manufacturing a terminal-equipped wire, the terminal-equipped wire including:

an electric wire having a conductor in an insulating coating; and a terminal fitting crimped to a terminal section of the electric wire, the terminal fitting including: an electrical contact portion for connecting with the terminal fitting of a mating connector; and a wire connection portion for being connected to the terminal section of the electric wire continuing to the electrical contact portion, the wire connection portion including: a grip for gripping the terminal section of the electric wire along a circumferential direction of the electric wire; and a bottomed cylindrical cap member that is conductive provided independently from the grip, the cap member including a projection projected from an inner surface of the cap member, the method comprising the steps of:

attaching the cap member to the terminal section of the electric wire;

inserting the terminal section of the electric wire and the cap member into the grip;

swaging the grip to press the cap member and the terminal section of the electric wire and to penetrate the insulating coating with the projection, thereby allowing the conductor and to have electrical continuity with the grip via the cap member.

Advantageous Effects of Invention

According to the invention as in the one aspect of the present invention, the wire connection portion of the terminal fitting includes: the grip; and the projection, and the conductor of the electric wire and the grip are electrically conducted to each other via the projection penetrating the insulating coating. Therefore, removing the insulating coating at the terminal section of the electric wire becomes unnecessary. Further, because the grip grips the terminal section of the electric wire covered by the insulating coating, the water is prevented from entering an interior of the insulating coating. Therefore, the water or the like is prevented from attaching to a contact portion between the projection penetrating the insulating coating and the conductor. Therefore, the conductor, the projection, and the terminal fitting are prevented from corrosion, and a product lifetime of the terminal-equipped wire is increased. Further, when the grip grips the terminal section of the electric wire, element wires composing the conductor are compressed and closely contact each other, and whereby the water or the like is also prevented from entering from a tip of the terminal section of the electric wire.

According to the invention as in the first preferred aspect of the present invention, tips of the pair of legs gripping the electric wire are continued to each other, and by compressing the legs, the insulating coating and the conductor closely contact each other and the element wires of the conductor closely contact each other to collapse gaps therebetween, whereby the water or the like is prevented from entering from the tips of these legs. Therefore, it becomes hard for the water or the like to reach the projection penetrating the insulating coating, the water proof performance and the corrosion proof performance of the conductor in the electric wire are further increased.

According to the invention as in the second preferred aspect of the present invention, corresponding to use of the terminal-equipped wire, a proper form can be selected from any of the projection integral with the grip and projected from the inner wall of the grip and the projection projected from the inner wall of the cap member independent from the grip. Therefore, when the terminal-equipped wire is installed on a water coated portion, the water proof performance can be increased by using the cap member. In contrast, when the terminal-equipped wire is installed on a portion where the water attach little, the production cost can be reduced by using the terminal-equipped wire having the grip integrally formed with the projection.

According to the invention as in the second aspect of the present invention, similarly to the above, the water or the like is prevented from attaching to a contact portion between the projection penetrating the insulating coating and the conductor. Therefore, the conductor and the terminal fitting are prevented from corrosion, and a product lifetime of the terminal-equipped wire is increased. Further, the production cost of the terminal-equipped wire can be reduced.

According to the invention as in the third aspect of the present invention, similarly to the above, the water or the like is prevented from attaching to a contact portion between the projection penetrating the insulating coating and the conductor. Therefore, the conductor and the terminal fitting are prevented from corrosion, and a product lifetime of the terminal-equipped wire is increased. Further, the corrosion performance can be further improved.

DESCRIPTION OF EMBODIMENTS

First Embodiment

Figure 1A:
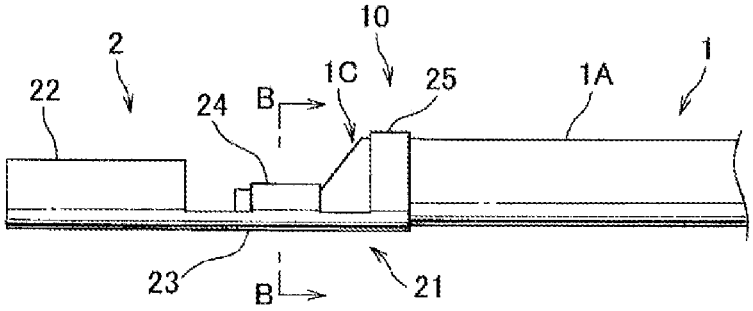
FIG. 1A is a side view showing a terminal-equipped wire according to a first embodiment of the present invention.

A terminal-equipped wire according to a first embodiment of the present invention will be explained with reference to FIGS. 1A to 3B. A terminal-equipped wire 10 according to the first embodiment is, for example, a component of a wiring harness connecting on-vehicle electronic devices to each other, and includes: an electric wire 1 having a conductor 1B in an insulating coating 1A; and a terminal fitting 2 crimped to a terminal section 1C of this electric wire 1. The conductor 1B of the electric wire 1 is, for example, a stranded wire made by twisting a plurality of element wires. As the element wire, for example, an annealed copper wire made of copper, copper alloy, a tin-plated copper wire, a nickel-plated copper wire, and an aluminum wire made of aluminum alloy can be used.

As shown in FIGS. 1A to 2C, the terminal fitting 2 is a female terminal made by folding a copper or copper alloy plate or the like, and includes: a wire connection portion 21 connected to the electric wire 1; an electrical contact portion 22 connected to a not-shown terminal fitting (male terminal) of a mating connector; and a coupling portion 23 coupling the wire connection portion 21 and the electrical contact portion 22 together. The wire connection portion 21 includes: front legs 24 respectively extended from the coupling portion 23; and rear legs 25 provided in rear of the front legs 24. The electrical contact portion 22 is formed in a rectangular tube shape, and the male terminal is inserted into the electrical contact portion 22 and contacts the electrical contact portion 22 to be electrically connected to the electrical contact portion 22.

Figure 1B:
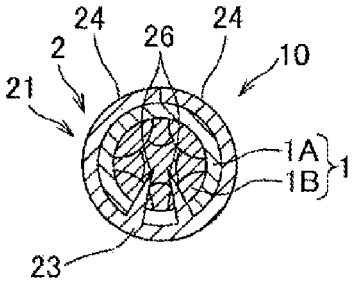
FIG. 1B is a sectional view showing a terminal-equipped wire according to a first embodiment of the present invention.
Figure 2A:
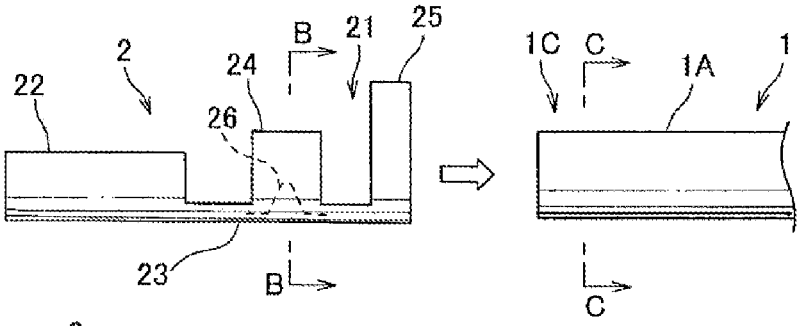
FIG. 2A is an explanatory view showing a manufacturing procedure of the terminal-equipped wire according to the first embodiment.
Figure 2B:
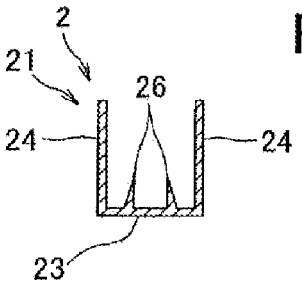
FIG. 2B is an explanatory view showing a manufacturing procedure of the terminal-equipped wire according to the first embodiment.
Figure 2C:
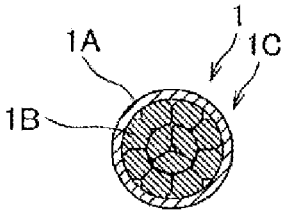
FIG. 2C is an explanatory view showing a manufacturing procedure of the terminal-equipped wire according to the first embodiment.

As shown in FIG. 2B, the front legs 24 of the wire connection portion 21 is composed of a pair extended from the coupling portion 23 and opposite to each other. When the pair of front legs 24 and the coupling portion 23 are swaged around the electric wire 1, the terminal section 1C of the electric wire 1 is gripped. Namely, the grip is composed of the coupling portion 23 and the front legs 24. As shown in FIG. 1B, this grip grips the terminal section 1C of the electric wire 1 by compressing a circumferential direction of the terminal section 1C and compressing element wires composing the conductor 1B to closely contact each other. In this way, when the terminal section 1C of the electric wire 1 is gripped, the tips of the front legs 24 are moved close to each other, and continued in a circle shape or a flat shape along a circumferential direction of the electric wire 1.

Figure 3A:
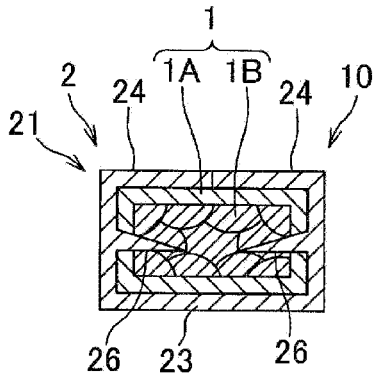
FIG. 3A is a sectional view showing a modified embodiment of the terminal-equipped wire according to the first embodiment.
Figure 3B:
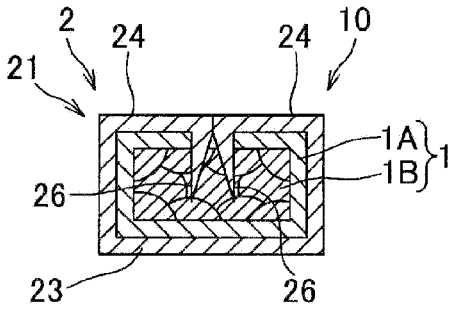
FIG. 3B is a sectional view showing a modified embodiment of the terminal-equipped wire according to the first embodiment.

Further, a pair of projections 26 is formed on the coupling portion 23 between the pair of front legs 24 and projected from an inner wall of the coupling portion 23. Namely, the grip composed of the coupling portion 23 and the front legs 24 and the projections 26 are formed integrally with each other. A tip of each projection 26 is formed sharply, and configured to stick into and penetrate the insulating coating 1A of the electric wire 1 and bite into the conductor 1B. The terminal fitting 2 and the conductor 1B are electrically connected to each other with these projections 26. Incidentally, the projections 26 are not limited to be projected from an inner wall of the coupling portion 23, but as shown in FIG. 3A, may be projected inward from middle positions of the front legs 24, or as shown in FIG. 3B, may be projected inward from the tips of the front legs 24.

Next, a method for manufacturing a terminal-equipped wire 10 according to this embodiment will be explained. First, as shown in FIG. 2A, while the front legs 24 and the rear legs 25 are extended straight, the terminal section 1C of the electric wire 1 having the insulating coating 1A is inserted into between the front legs 24 and between the rear legs 25. At this time, in the electric wire 1 before caulking, gaps are generated between the element wires of the conductor 1B, and the element wires do not closely contact each other. Next, using a not-shown swaging device, the front legs 24 and the rear legs 25 are respectively swaged to press-contact the terminal section 1C of the electric wire 1. At this time, specifically, the front legs 24 are bent in a direction that the tips of the pair of front legs 24 are moved close to each other, and the front legs 24 are swaged while pressed toward the coupling portion 23. Thereby, as shown in FIGS. 1A and 1B, the projections 26 stick into the terminal section 1C of the electric wire 1 to penetrate the insulating coating 1A. Further, the terminal section 1C of the electric wire 1 is compressed by the front legs 24 to make the element wires of the conductor 1B closely contact each other and the projections 26 bite into the conductor 1B.

According to this embodiment described above, the projections 26 formed on the terminal fitting 2 penetrate the insulating coating 1A of the electric wire 1, and these projections 26 electrically connect the conductor 1B with the terminal fitting 2. Therefore, it becomes unnecessary to remove the insulating coating 1A at the terminal section 1C of the electric wire 1 and the terminal section 1C covered by the insulating coating 1A is gripped by the front legs 24 and the coupling portion 23. Thereby, the water or the like is prevented from entering an inside of the insulating coating 1A. Further, when the front legs 24 are swaged, the terminal section 1C of the electric wire 1 is compressed to make the element wires of the conductor 1B closely contact each other. Thereby, the water or the like is also prevented from entering from a tip of the terminal section 1C of the electric wire 1. Therefore, the water or the like is prevented from entering with respect to a contact portion between the projections 26 penetrating the insulating coating 1A and the conductor 1B. Therefore, the conductor 1B and the projections 26 are prevented from corrosion, and a product lifetime of the terminal-equipped wire 10 is increased.

Second Embodiment

Figure 5A:
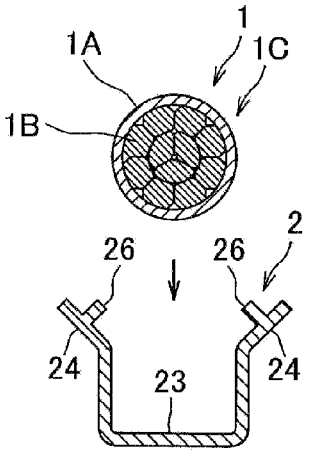
FIG. 5A is an explanatory view showing a manufacturing procedure of the terminal-equipped wire according to the second embodiment.
Figure 5B:
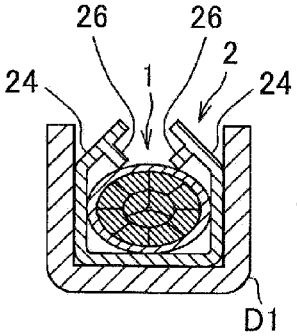
FIG. 5B is an explanatory view showing a manufacturing procedure of the terminal-equipped wire according to the second embodiment.
Figure 5C:
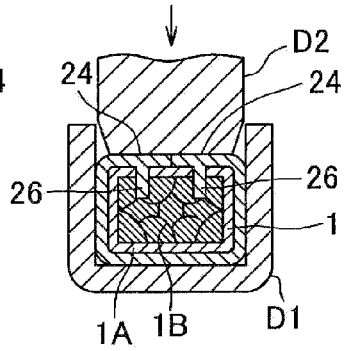
FIG. 5C is an explanatory view showing a manufacturing procedure of the terminal-equipped wire according to the second embodiment.
Figure 6:
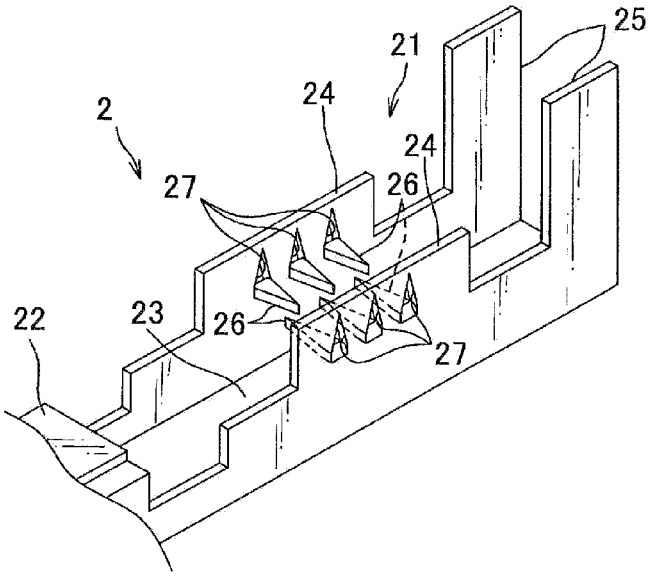
FIG. 6 is a perspective view showing a modified embodiment of the terminal-equipped wire according to the second embodiment.

A terminal-equipped wire according to a second embodiment of the present invention will be explained with reference to FIGS. 4 to 6. A terminal-equipped wire 10 according to this embodiment is different from that according to the first embodiment at a point that the projections 26 are made by notching and folding the front legs 24 of the terminal fitting 2. Hereafter, the difference will be explained in detail.

Figure 4:
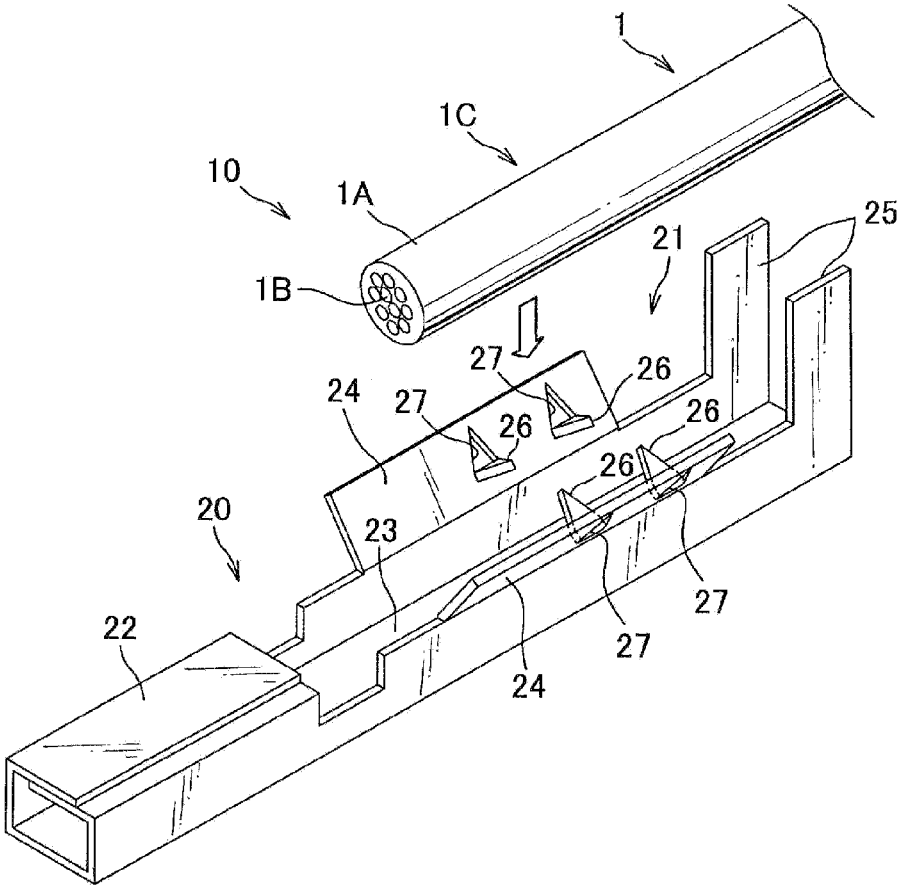
FIG. 4 is an exploded perspective view showing a terminal-equipped wire according to a second embodiment of the present invention.

As shown in FIG. 4, each of the pair of front legs 24 is provided with two notches 27 at opposite positions, and each of these notches 27 is formed by two sides of an isosceles triangle of which a vertex is positioned toward a tip of the front leg 24. Then, the notch 27 of the two sides is folded inward in an opposite direction of the front legs 24 to form the projection 26. As shown in FIGS. 5A to 5C, in a method for manufacturing the terminal-equipped wire 10 using this terminal fitting 2, a lower die D1 and an upper die D2 are used for connecting the electric wire 1 with the terminal fitting 2.

In specific steps, firstly as shown in FIG. 5A, the terminal section 1C of the electric wire 1 is inserted into an inside surrounded by the front legs 24 and the coupling portion 23 of the terminal fitting 2 in which the pair of front legs 24 is opened in a direction separating from each other. Next, as shown in FIG. 5B, when the terminal fitting 2 and the electric wire 1 are inserted into the U-shaped lower die D1, the front legs 24 slidably abutted on a sidewall of the lower die D1 are pressed inward in a direction that the front legs 24 are moved close to each other and inclined inward. Further, the front legs 24 are disposed along the terminal section 1C of the electric wire 1, and the tips of the projections 26 are abutted on the insulating coating 1A of the electric wire 1. Next, as shown in FIG. 5C, the upper die D2 is inserted into the lower die D1. When the front legs 24 are pressed toward the terminal section 1C of the electric wire 1, the projections 26 penetrate the insulating coating 1A of the electric wire 1, and are moved to an inside of the conductor 1B. Then, when the front legs 24 are swaged along the terminal section 1C, the electric wire 1 and the terminal fitting 2 are press-connected to each other.

Incidentally, the terminal fitting 2 according to this embodiment is not limited to the above. The number of the projections 26 may be properly increased for improving electrical continuity between the electric wire 1 and the conductor 1B. The projection 26 may be formed longer for biting deeply to the conductor 1B. Here, when the projection 26 is formed longer, as shown in FIG. 6, the projections 26 on the front legs 24 in one side and the projections 26 on the front legs 24 in the other side are formed at different positions in a longitudinal direction of the electric wire 1 so that the tips of the projections 26 on the pair of front legs 24 will be prevented from interfering with each other. In this way, by increasing the number of the projections 26 and by biting deeply to the conductor 1B with the longer projection 26, the electrical continuity between the conductor 1B and the terminal fitting 2 are further increased.

Third Embodiment

A terminal-equipped wire according to a third embodiment of the present invention will be explained with reference to FIGS. 7A to 8D. A terminal-equipped wire 10 according to this embodiment is different from those according to the first and second embodiments at a point that the projections 26 are not formed on the terminal fitting 2, a cap member 3 independent from the terminal fitting 2 is provided, a projection 33 is formed on the cap member 3, and the conductor 1B of the electric wire 1 and the terminal fitting 2 are electrically connected to each other via the projection 33 of the cap member 3. Hereinafter, the difference will be explained in detail.

The cap member 3 is made of conductive metal, and includes: a cylindrical cap main body 31 allowing the terminal section 1C of the electric wire 1 to be inserted thereinto; a bottom portion 32 covering one end of the cap main body 31; and a plurality of projections 33 projected from an inner wall of the cap main body 31. While the terminal section 1C of the electric wire 1 is inserted into the cap main body 31, when the cap member 3 is swaged together with the front legs 24 of the terminal fitting 2, the projections 33 are configured to stick into and penetrate the insulating coating 1A of the electric wire 1 and bite into the conductor 1B. The terminal fitting 2 and the conductor 1B are electrically connected to each other with these projections 33 and the cap main body 31.

Figure 7A:
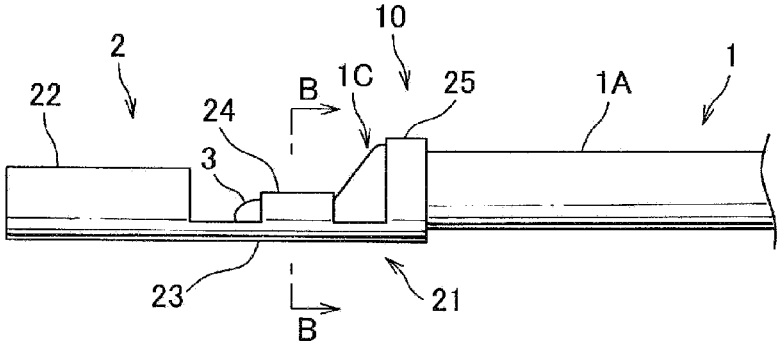
FIG. 7A is a side view showing a terminal-equipped wire according to a third embodiment of the present invention.
Figure 7B:
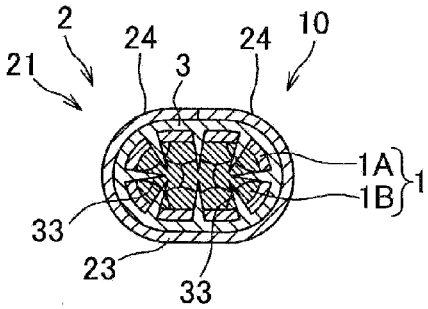
FIG. 7B is a sectional view showing a terminal-equipped wire according to a third embodiment of the present invention.
Figure 8A:
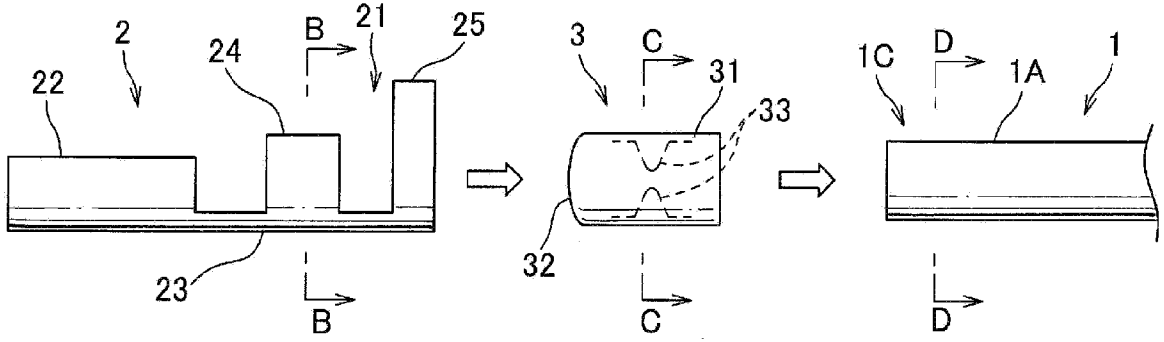
FIG. 8A is an explanatory view showing a manufacturing procedure of the terminal-equipped wire according to the third embodiment.
Figure 8D:
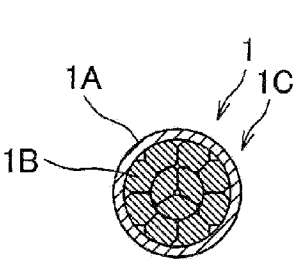
FIG. 8D is an explanatory view showing a manufacturing procedure of the terminal-equipped wire according to the third embodiment.
Figure 8C:
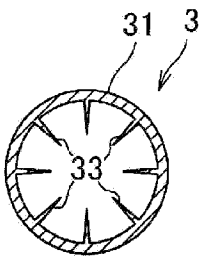
FIG. 8C is an explanatory view showing a manufacturing procedure of the terminal-equipped wire according to the third embodiment.
Figure 8B:
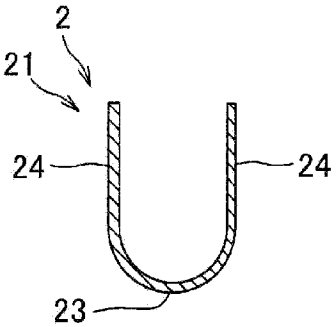
FIG. 8B is an explanatory view showing a manufacturing procedure of the terminal-equipped wire according to the third embodiment.
Figure 9A:
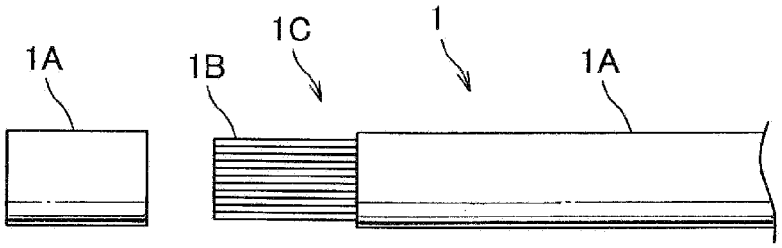
FIG. 9A PRIOR ART
FIG. 9A is an explanatory view showing a manufacturing procedure of a conventional terminal-equipped wire.
Figure 9B:
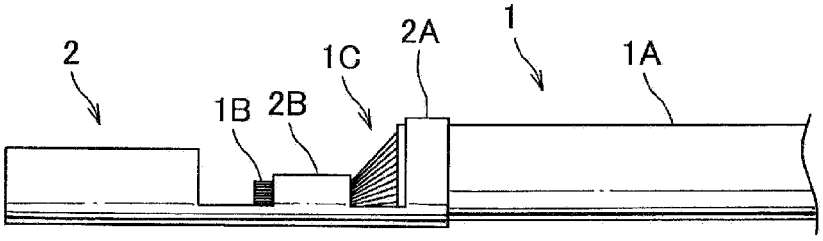
FIG. 9B PRIOR ART
FIG. 9B is an explanatory view showing a manufacturing procedure of the conventional terminal-equipped wire.
Figure 9C:
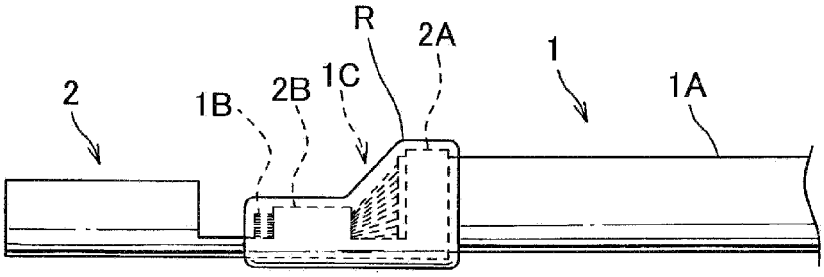
FIG. 9C PRIOR ART
FIG. 9C is an explanatory view showing a manufacturing procedure of the conventional terminal-equipped wire.

Next, a method for manufacturing a terminal-equipped wire 10 according to this embodiment will be explained. First, as shown in FIG. 8, the terminal section 1C of the electric wire 1 is inserted into the cap member 3, and this cap member 3 and the electric wire 1 are inserted into between the pair of front legs 24 and between the rear legs 25 of the terminal fitting 2. Next, using a not-shown swaging device, the front legs 24 and the rear legs 25 are respectively swaged and the cap member 3 is also swaged to press-contact the front legs 24, the cap member 3, and the terminal section 1C of the electric wire 1. At this time, when the cap member 3 is swaged together with the front legs 24, as shown in FIG. 7B, the projections 33 stick into the terminal section 1C of the electric wire 1, and penetrate the insulating coating 1A. Further, the cap member 3 compresses the terminal section 1C of the electric wire 1 to make the element wires of the conductor 1B closely contact each other, and the projections 33 bite into the conductor 1B.

According to this embodiment described above, the projections 33 formed on the inner wall of the cap member 3 penetrate the insulating coating 1A of the electric wire 1, and these projections 33 electrically connect the conductor 1B with the terminal fitting 2. Therefore, it becomes unnecessary to remove the insulating coating 1A at the terminal section 1C of the electric wire 1 and the terminal section 1C covered by the insulating coating 1A is gripped by the front legs 24 and the coupling portion 23. Thereby, the water or the like is prevented from entering an inside of the insulating coating 1A. Further, when the front legs 24 are swaged, the terminal section 1C of the electric wire 1 is compressed to make the element wires of the conductor 1B closely contact each other. Thereby, the water or the like is also prevented from entering from a tip of the terminal section 1C of the electric wire 1. Therefore, the water or the like is prevented from entering with respect to a contact portion between the projections 33 penetrating the insulating coating 1A and the conductor 1B. Therefore, the conductor 1B and the projections 33 are prevented from corrosion, and a product lifetime of the terminal-equipped wire 10 is increased. Further, when the cap member 3 covers the terminal section 1C of the electric wire 1, the water is prevented from entering from a tip of the electric wire 1, whereby the water proof and corrosion proof performances are further increased.

Incidentally, the above embodiments only show typical embodiments of the present invention, and the present invention is not limited to these embodiments. Namely, various modifications can be carried out within the scope of the present invention.

For example, the terminal-equipped wire 10 of the above embodiments includes: the electric wire 1; and the terminal fitting 2 as a female terminal. However, the terminal fitting may be a male terminal or a plate-shaped terminal. Further, according to the above embodiments, the terminal fitting 2 includes: the front legs 24; and the rear legs 25. They may be continued to each other to swage the terminal section 1C, or instead of the pair of legs, the terminal fitting may have a circular grip. Further, according to the above embodiments, the conductor 1B of the electric wire 1 is composed of a stranded wire made by twisting a plurality of element wires.

However, the conductor may be composed of a single wire.

REFERENCE SIGNS LIST

1 electric wire
1A insulating coating
1B conductor
1C terminal section
2 terminal fitting
3 cap member
21 wire connection portion
22 electrical contact portion
23 coupling portion (grip)
24 front legs (grip)
26, 33 projections

The invention claimed is:

1. A terminal-equipped wire comprising:

an electric wire having a conductor covered by an insulating coating; and a terminal fitting crimped to a terminal section of the electric wire, wherein the terminal fitting includes: an electrical contact portion for being electrically connected to a mating connector; and a wire connection portion for being connected to the terminal section of the electric wire continuing to the electrical contact portion, wherein the wire connection portion includes: a grip for gripping the terminal section of the electric wire along a circumferential direction of the electric wire; and a bottomed cylindrical cap member that is conductive provided independently from the grip, wherein the cap member including a projection projected from an inner surface of the cap member, and penetrating the insulating coating, and wherein the conductor electrically continues to the grip via the cap member.

2. The terminal-equipped wire as in claim 1, wherein the grip includes a pair of legs for gripping the terminal section of the electric wire by swaging, and wherein while the electric wire is gripped, tips of the pair of legs are continued to each other in a circular shape or in a flat shape along the circumferential direction of the electric wire.

3. A method for manufacturing a terminal-equipped wire, the terminal-equipped wire including:

an electric wire having a conductor in an insulating coating; and a terminal fitting crimped to a terminal section of the electric wire, the terminal fitting including: an electrical contact portion for connecting with the terminal fitting of a mating connector; and a wire connection portion for being connected to the terminal section of the electric wire continuing to the electrical contact portion, the wire connection portion including: a grip for gripping the terminal section of the electric wire along a circumferential direction of the electric wire; and a bottomed cylindrical cap member that is conductive provided independently from the grip, the cap member including a projection projected from an inner surface of the cap member, the method comprising the steps of:

attaching the cap member to the terminal section of the electric wire;

inserting the terminal section of the electric wire and the cap member into the grip;

swaging the grip to press the cap member and the terminal section of the electric wire and to penetrate the insulating coating with the projection, thereby allowing the conductor and to have electrical continuity with the grip via the cap member.

* * * * *